US009809334B2

(12) United States Patent
Kramme et al.

(10) Patent No.: US 9,809,334 B2
(45) Date of Patent: Nov. 7, 2017

(54) VENDING MACHINE

(71) Applicants: Mark A. Kramme, Canyon Country, CA (US); Christian Clark Kramme, Canyon Country, CA (US)

(72) Inventors: Mark A. Kramme, Canyon Country, CA (US); Christian Clark Kramme, Canyon Country, CA (US)

( * ) Notice: Subject to any disclaimer, the term of this patent is extended or adjusted under 35 U.S.C. 154(b) by 374 days.

(21) Appl. No.: 14/600,957

(22) Filed: Jan. 20, 2015

(65) Prior Publication Data

US 2016/0207656 A1 Jul. 21, 2016

(51) Int. Cl.

| | |
|---|---|
| ***B65B 57/00*** | (2006.01) |
| ***B65B 5/06*** | (2006.01) |
| ***G07F 17/00*** | (2006.01) |
| ***G07F 11/04*** | (2006.01) |
| *B65B 63/00* | (2006.01) |

(52) U.S. Cl.

CPC ..... *B65B 5/067* (2013.01); *G07F 11/04* (2013.01); *G07F 17/0092* (2013.01); *B65B 63/005* (2013.01)

(58) Field of Classification Search

CPC ..... G07F 11/04; G07F 17/0092; B65B 5/067; B65B 57/00; B65B 1/04; B65B 35/32; B65B 39/007; B65B 63/005; B65B 61/025; B65B 61/00

USPC ..... 53/428, 154, 493

See application file for complete search history.

(56) References Cited

U.S. PATENT DOCUMENTS

| | | | | |
|---|---|---|---|---|
| 9,607,465 | B2 * | 3/2017 | Bruck | G07F 11/02 |
| 2002/0173875 | A1 * | 11/2002 | Wallace | G06F 19/322 700/242 |
| 2004/0215369 | A1 * | 10/2004 | Rosenblum | G06F 19/3462 700/235 |
| 2005/0021173 | A1 * | 1/2005 | Pinney | G06F 19/3462 700/231 |
| 2005/0049746 | A1 * | 3/2005 | Rosenblum | G06F 19/3462 700/232 |
| 2006/0272976 | A1 * | 12/2006 | Pinney | A61J 1/00 206/466 |
| 2008/0029530 | A1 * | 2/2008 | Yuyama | B41J 2/325 221/2 |
| 2012/0216485 | A1 * | 8/2012 | Amano | G07F 11/44 53/64 |
| 2013/0042943 | A1 * | 2/2013 | Bassani | B65G 27/04 141/11 |

(Continued)

*Primary Examiner* — Michelle Lopez
*Assistant Examiner* — Chinyere Rushing-Tucker

(57) ABSTRACT

A vending machine provides a housing for enclosing a container unit, a printing unit, a bagging unit, and a retrieval bin. The units are connected to each other by a number of passages that allow stored products to be transported between the units. Customers interact with the vending machine via a terminal, which actuates other components based on customer inputs. The container unit serves as a primary storage, holding the product until a customer makes a purchase. The requested product is then funneled into a primary passage, either towards the bagging unit or forked to the printing unit if necessary. The bagging unit has a door that allows the product to drop into a bag. The bag itself is retrieved from a storage area and positioned below the door by a bag manipulating mechanism. It is then sealed and dropped into the retrieval bin to allow a customer access.

18 Claims, 9 Drawing Sheets

(56) References Cited

U.S. PATENT DOCUMENTS

2013/0318931 A1* 12/2013 Holmes ..... B65B 1/02
53/562
2014/0261058 A1* 9/2014 Henderson ..... A61G 12/001
104/288
2014/0303774 A1* 10/2014 Schwarzli ..... G07F 9/02
700/233
2014/0318078 A1* 10/2014 Kondo ..... B65B 57/10
53/54
2015/0314898 A1* 11/2015 Schwarzli ..... G07F 11/44
53/411

* cited by examiner

VENDING MACHINE

FIELD OF THE INVENTION

The present invention relates generally to a vending machine construction with specific storage and dispensing mechanisms suited for dispensing pharmaceuticals.

BACKGROUND OF THE INVENTION

Vending machines, since their introduction, have undergone a number of evolutions and adaptations, with new designs being provided for specific purposes or to generally improve the user experience, efficiency, simplicity, and a host of other factors. The present invention provides an improved system for storing and dispensing products, with the dispensed products being enclosed in a bag. While the present invention has been designed with pharmaceuticals in mind, it can be utilized as a platform for any type of product, such as foods, beverages, and novelties.

The present invention provides an easily serviceable container unit, allow for quick and simple restocking. The container unit feeds products to a bagging unit through a system of passages, including a detour passage which routes through a printing unit that can be used to provide relevant information (e.g. drug information) for purchased products. A bagging unit uses a mechanical arm to move bags from a storage area into position below a drop point of the passages, allowing purchased products and any relevant printed information to be enclosed in the bag. The purchased product is then made accessible to a user via a retrieval bin. It is through this general configuration and process that the present invention improves upon the prior art.

DETAIL DESCRIPTIONS OF THE INVENTION

All illustrations of the drawings are for the purpose of describing selected versions of the present invention and are not intended to limit the scope of the present invention.

Figure 1:
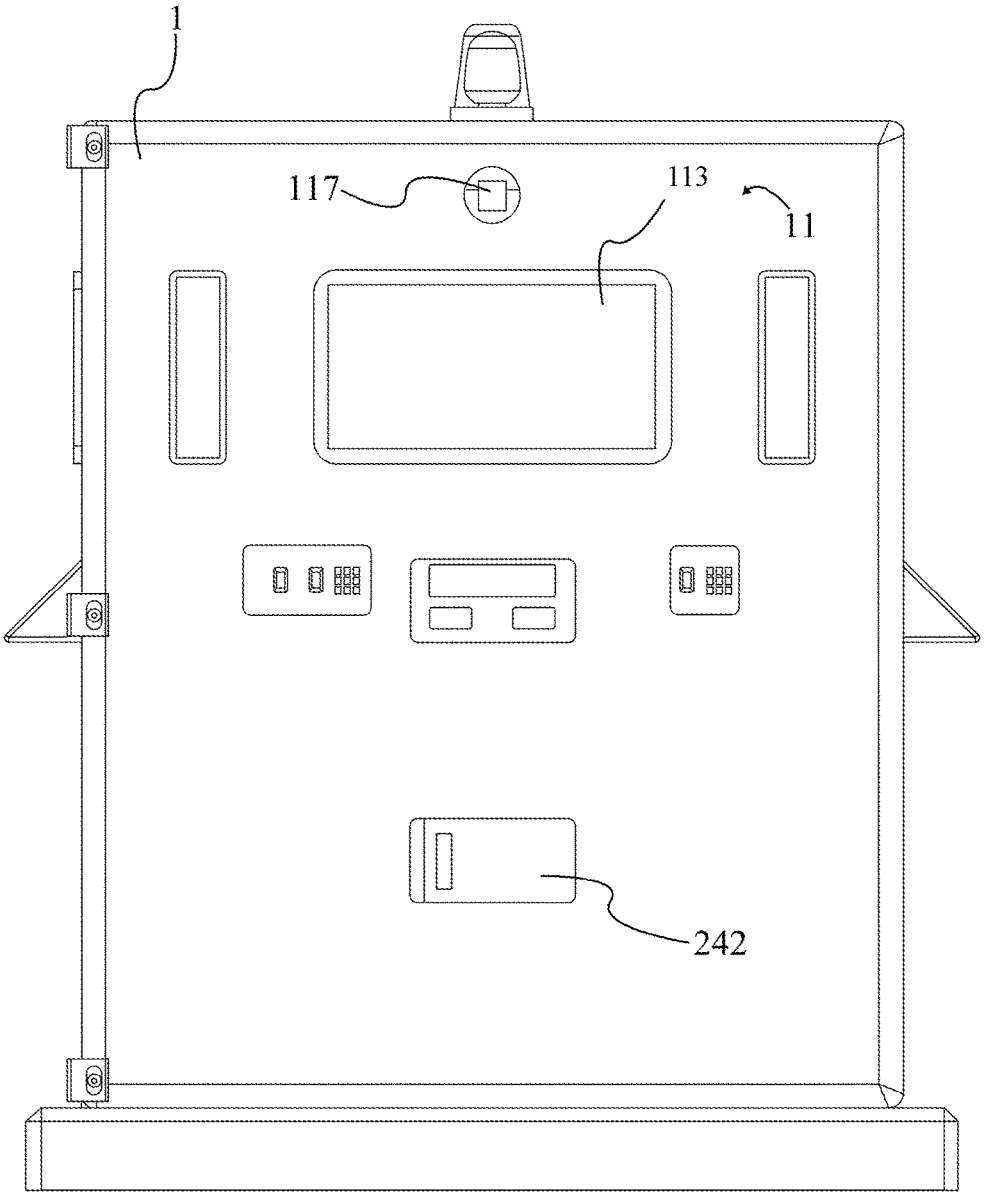
FIG. 1 is a front elevational view showing a terminal and housing of the present invention.
Figure 2:
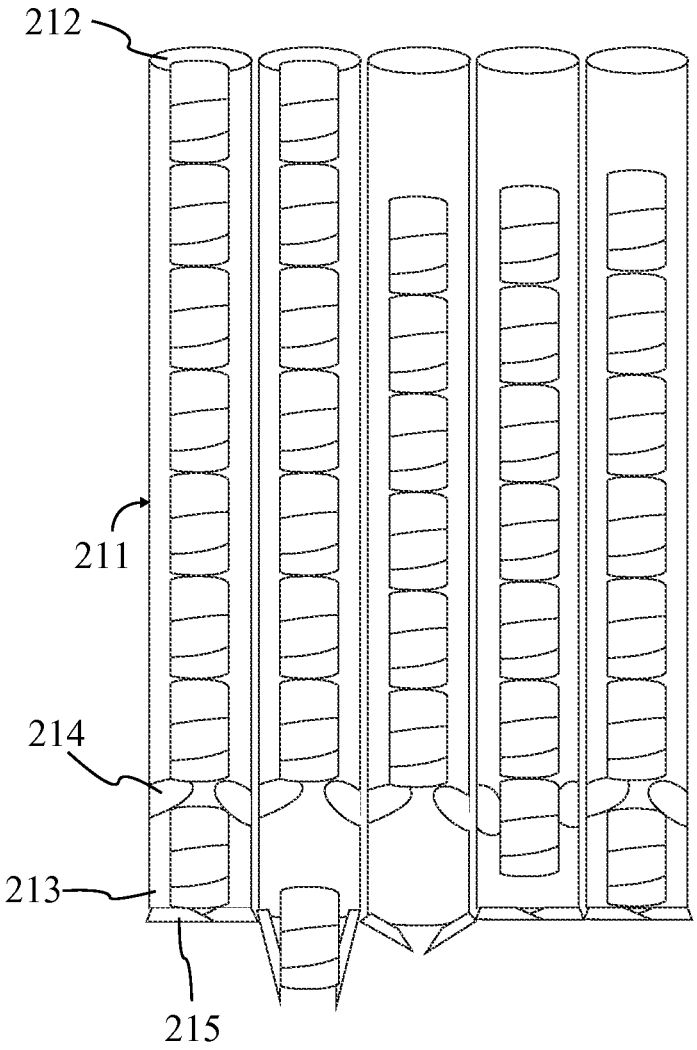
FIG. 2 is an isolated drawing showing a plurality of chutes of a dispensing unit of the present invention.
Figure 3:
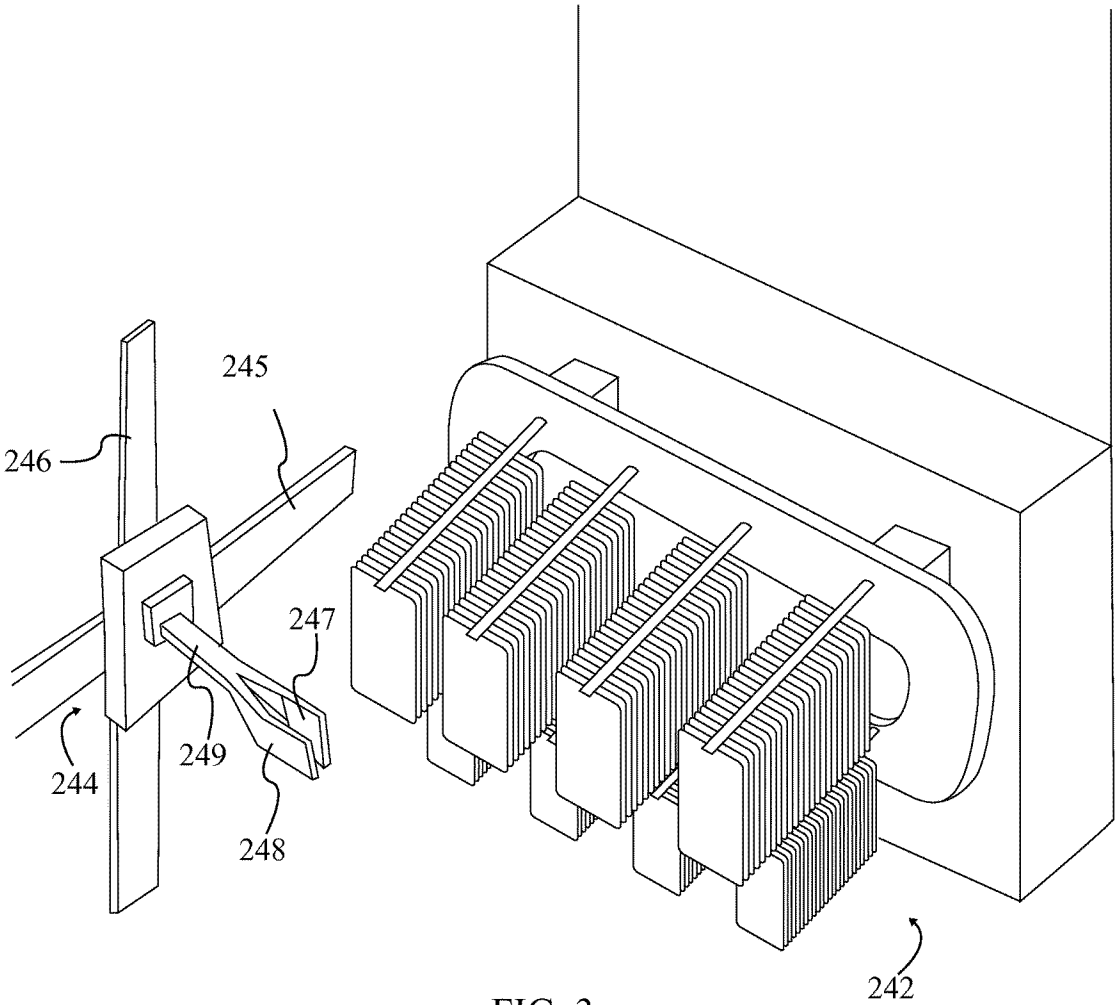
FIG. 3 is an isolated drawing showing a bagging unit of the present invention.
Figure 4:
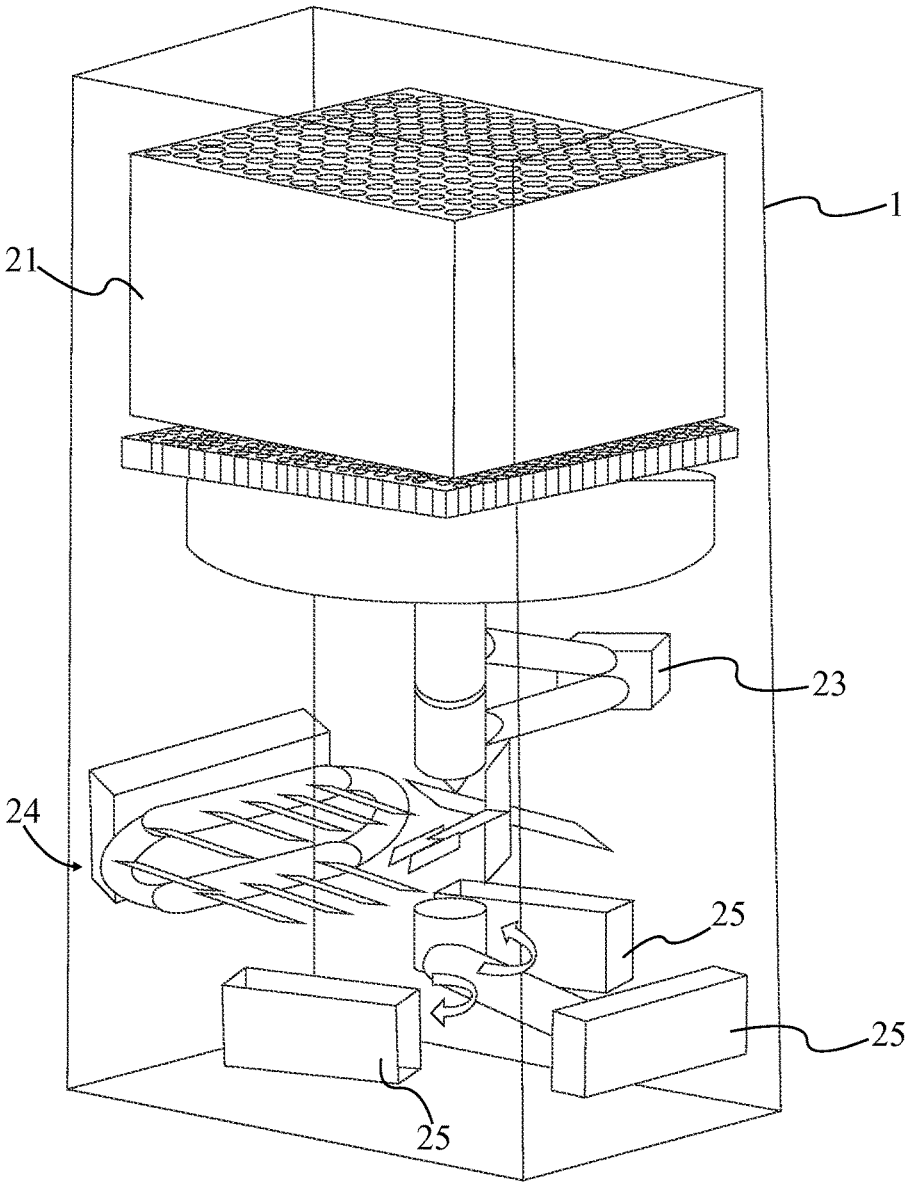
FIG. 4 is drawing showing the housing and internal components of the present invention.
Figure 5:
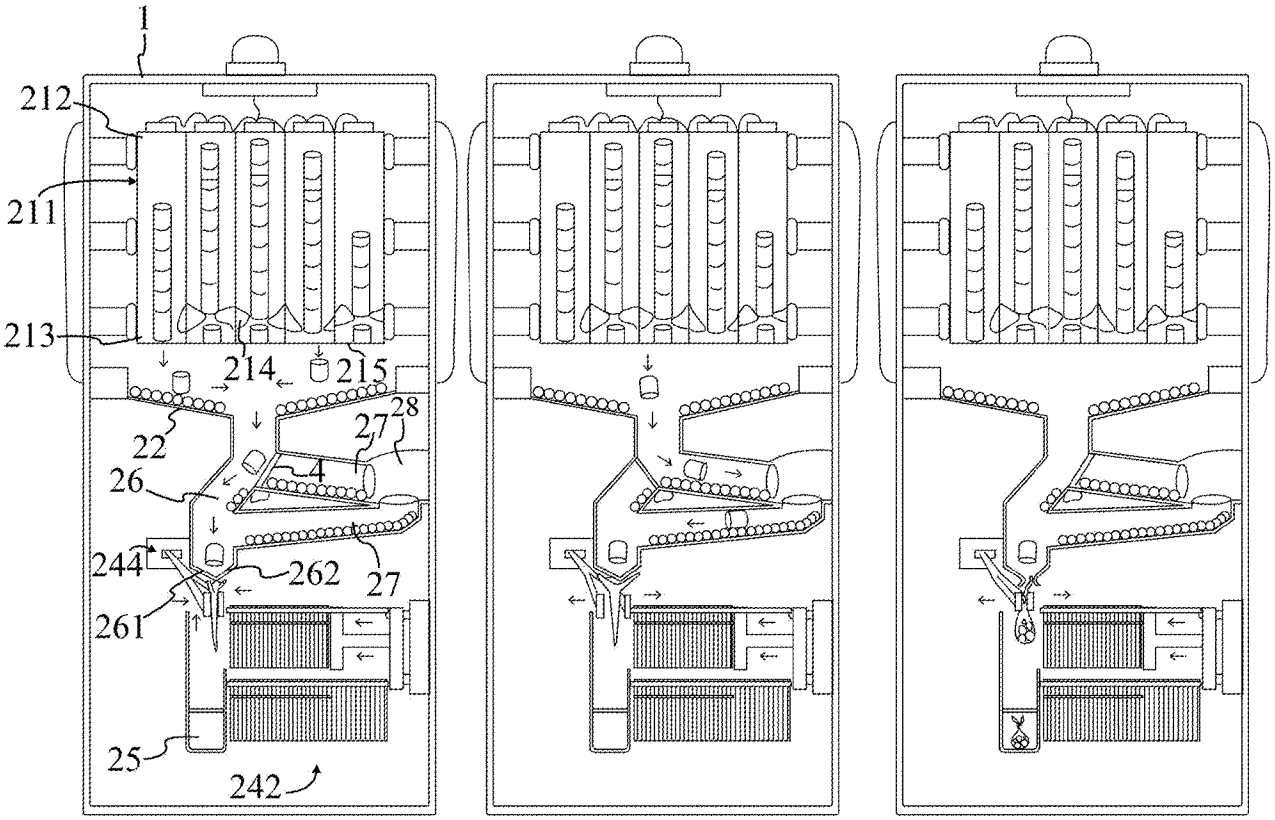
FIG. 5 is a drawings showing the process of a product being dispensed through the dispensing unit and bagging unit of the present invention.
Figure 6:
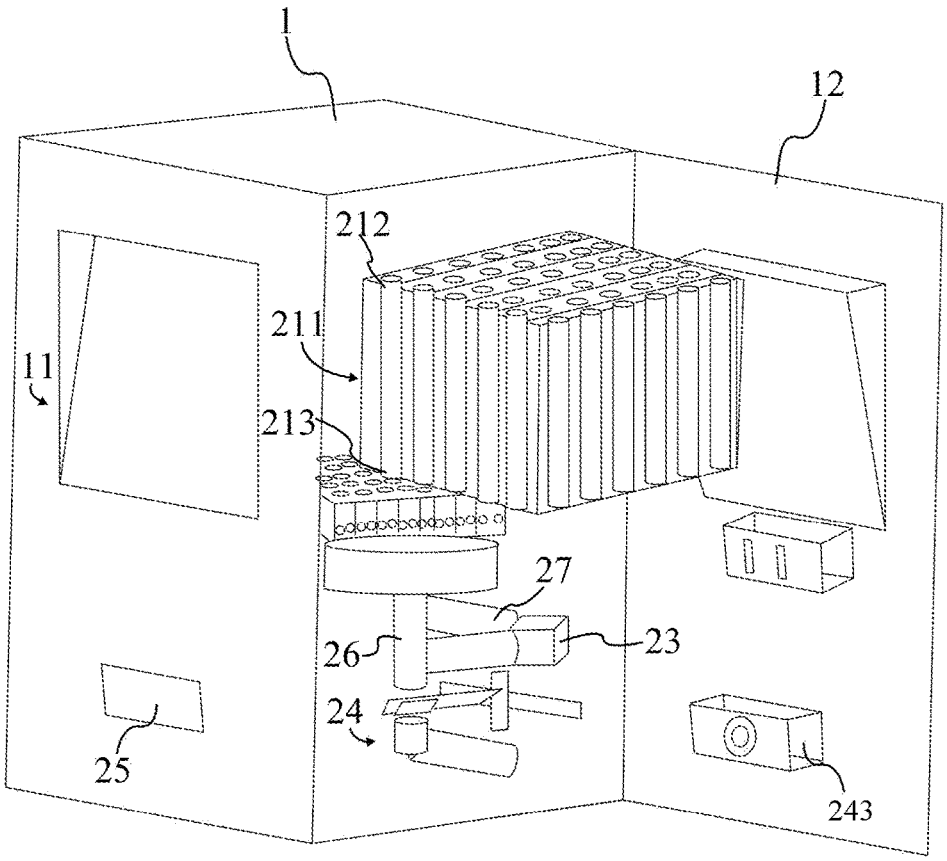
FIG. 6 is a drawing showing how the container unit may be accessed and serviced.
Figure 7:
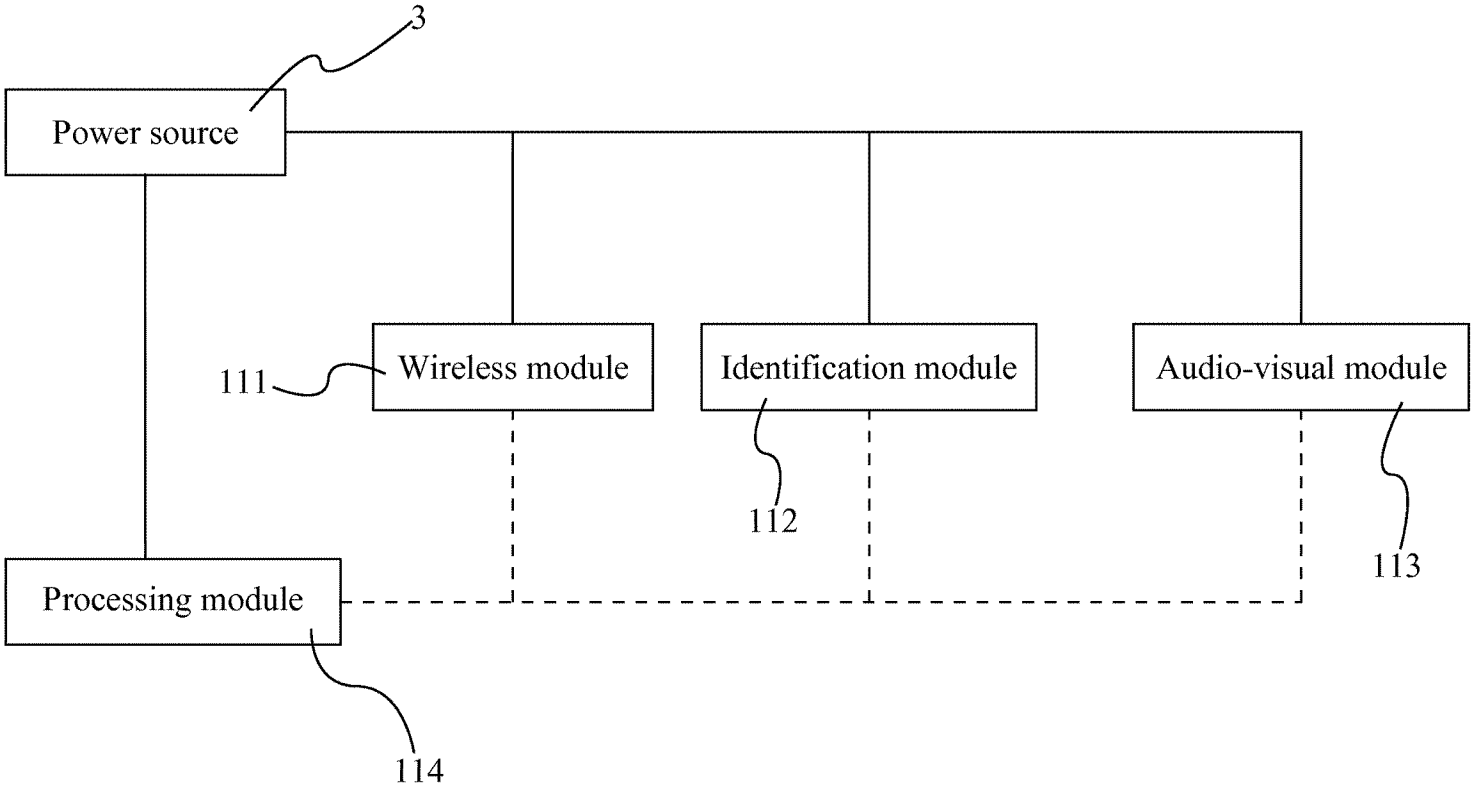
FIG. 7 is a diagram detailing basic electrical and electronic connections of the present invention.
Figure 8:
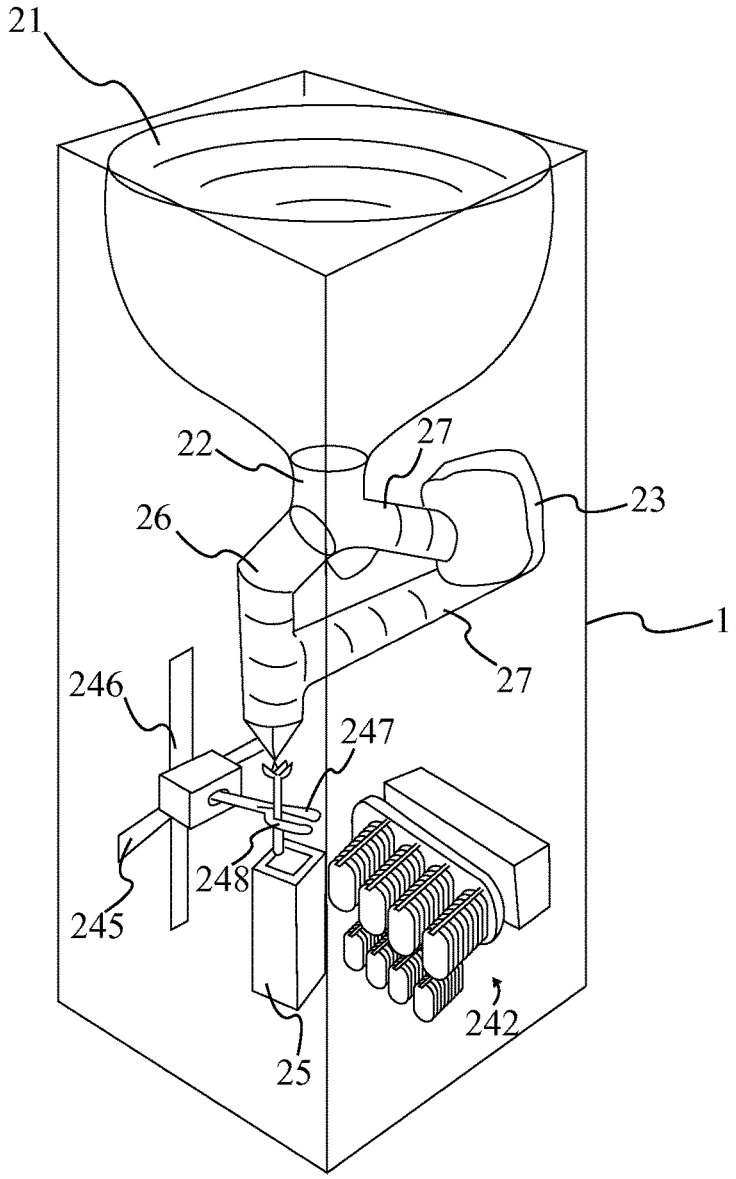
FIG. 8 is a drawing of an alternative design for the present invention.
Figure 9:
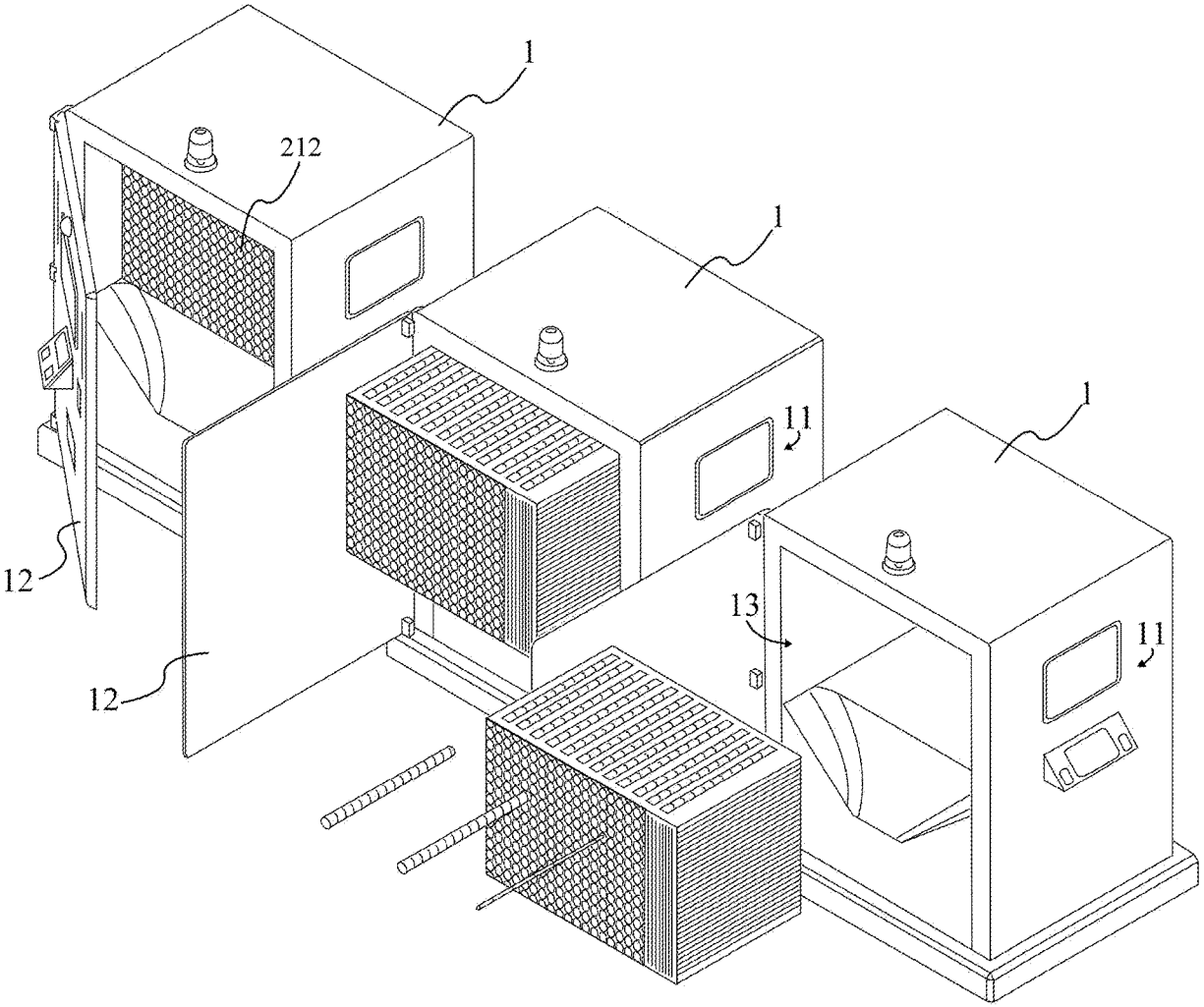
FIG. 9 is another drawing showing an alternative design of the present invention, including container unit servicing.

The present invention is a vending machine oriented towards dispensing pharmaceuticals, thought it is not limited to such and can ultimately be used to dispense other types of goods. The present invention provides a housing 1 that encloses, secures, or otherwise supports other components, namely a dispensing system 2, a controls system, and a terminal 11. The terminal 11 acts as a user interface which allows persons to identify and purchase specific products. Once a user purchases a specific medicine, the terminal 11 sends the relevant information to the controls system. The controls system then actuates specific components of the dispensing system 2 in order to dispense the requested medicine to a user. The present invention is illustrated, including potential embodiments, via FIG. 1-FIG. 9.

As a user must be able to interact with the terminal 11, the terminal 11 is positioned on an external surface of the housing 1. The terminal 11 is additionally connected to housing 1, providing a stable user interface through which orders may be placed. Different embodiments may utilize different styles and placements for the terminal 11. The terminal 11 can be a capacitive touch screen, or a more traditional button layout. The terminal 11 can be flush with the surface of the housing 1, or can instead be recessed into the housing 1, perhaps to protect against weather or provide improved user privacy. These are just a few examples of different implementations for the terminal 11, and do not limit the use of further alternative constructions and orientations for the terminal 11. The terminal 11 provides a user interface with an input mechanism, a primary display (for ordering), and a secondary display (for communicating with a tender as later described). Potentially, the input mechanism could be incorporated into the displays, e.g. by using capacitive touch screens as the displays.

The dispensing system 2 is provided to products from a holding area to an accessible area from which a user can retrieve their purchased product. The dispensing system 2 comprises a container unit 21, a printing unit 23, a bagging unit 24, and a retrieval bin 25. Allowing products to be transferred between these units are a funnel 22, a primary passage 26, a detour passage 27, and a terminal passage 28. The container unit 21 stores the various products which are sold through the present invention. When a specific product is requested, it is released from the container unit 21 into the funnel 22, which is positioned below the container unit 21 and above the primary passage 26. The funnel 22 guides the released product into the primary passage 26. From the primary passage 26, the product can be sent directly to the bagging unit 24 or instead passed through the detour passage 27 to the printing unit 23. Effectively, the primary passage 26 forks to provide two routes to a released product. The first route is provided for products that do not need a printout (e.g. a data sheet or instructions), while the second route is provided for products which require a printout.

The product will always end up at the bagging unit 24, as the primary passage 26 terminates at the bagging unit 24, while the detour passage 27 reconnects with the primary passage 26 after passing through the printing unit 23. After moving through the bagging unit 24, the product is transferred to the retrieval bin 25 through the terminal passage 28. This general process allows the purchased product to be dispensed from the container unit 21 and made accessible to a user through the retrieval bin 25. Since the retrieval bin 25 is intended to allow a user to pick up their purchased product, it must be user accessible. Thus the retrieval bin 25 is positioned in a recess of the housing 1 where it can both be accessed by a user and receive dispensed products from the other components of the dispensing mechanism 243. To enable transfer of a pharmaceutical product from the container unit 21 to the retrieval bin 25, there are several addition components that facilitate dispensing of said pharmaceuticals. In embodiments where multiple terminals 11 are provided, it is necessary to have multiple retrieval bins 25. In such embodiments, the terminal passage 28 is rotatable about a center axis, allowing it to dispense products to any of the multiple retrieval bins 25.

The container unit 21 comprises a plurality of product-storing chutes 211, with each product-storing chute 211 being used to store a different product. For example, using pharmaceuticals as an example, separate chutes might be provided for antibiotics, antiseptics, and contraceptives. These are just a few example of potential categories; a vendor may choose to stock any combination of products in the plurality of product-storing chutes 211. Each of these product-storing chutes 211 comprises a loading end 212, a dispensing end 213, a retarding mechanism 214, and a door 215. The loading end 212 is open, allowing the product-storing chutes 211 to easily be restocked during regular service of the present invention. At the other end of each product-storing chute 211 is the dispensing end 213, through which products are ejected towards the funnel 22 and into the primary passage 26. The dispensing end 213 is selectively sealed by a door 215, which remains closed until a user purchases a product from the corresponding product-storing chute 211. The door 215 then opens to allow a product from the chute to be ejected into the funnel 22 and primary passage 26. To ensure that only one product is dispensed at a time, a retarding mechanism 214 is positioned next to the door 215. The retarding mechanism 214 slows the passage of products, such as through a roller panel, in order to provide enough time for the door 215 to close after the requested product has been released. This is a simple implementation of ensuring that only a single product is dispensed at a given time, though other configurations are possible.

In fact, the retarding mechanism 214 can be rendered unnecessary if the container unit 21 is horizontally oriented, such that the product-storing chutes 211 are parallel with the floor of the housing 1; unlike a vertical orientation, gravity would not act upon the chutes and resultantly negate the issue of multiple products being dispensed unintentionally. However, such an embodiment would require an active "ejection mechanism" to create initial movement of the products, as opposed to the passive initiation (via gravity) previously described. A number of ejection mechanisms are possible, examples of which include a rotatable coil and a sled. Any device which can effectively push the products along the product-storing chute 211 and through the door 215 is suitable for use with a horizontally oriented container unit 21 of the present invention.

The container unit 21 can be made removable in order to facilitate restocking of the present invention. To support this, the housing 1 additionally comprises a removable cover 12 positioned over a unit-receiving cavity 13. This cover, which can be implemented in various ways such as being a sliding cover or hinged cover, permits or blocks access to the container unit 21. For example, the cover can be flipped open (assuming a hinged cover) to provide access to the container unit 21. The container unit 21 is intended to be removable from the unit-receiving cavity 13; this can be accomplished in a variety of ways, such as being slidably engaged with a track system mounted in the unit-receiving cavity 13. The implementation of a removable container unit 21 is advantageous from the perspective of restocking. Rather than having to reload individual product-storing chutes 211 while working within the confines of the housing 1, a service worker can remove the entire container unit 21. A new, fully stocked container unit 21 can then be placed in the unit-receiving cavity 13, effectively restocking the present invention in an expedited manner. The depleted container unit 21 could also be manually refilled, e.g. with a service worker reloading individual product-storing chutes 211 one at a time. Both of these examples show how a removable container unit 21 is an advantageous option for the present invention. Though a track system has been provided as an example for a means to remove and insert the container unit 21 from the housing 1, different implementations may be applied with different embodiments of the present invention.

The components of the container unit 21, in combination with the plurality of chutes, allow products to be sent to the bagging unit 24, detouring at the printing unit 23 if necessary. This is controlled by a switch 4, which can be opened or closed to direct dispensed products into the primary passage 26 or the detour passage 27. The printing unit 23 provides a printer that can print out relevant information for the purchased product. The printer is provided with said product information when a user makes a purchase, at which point the terminal 11 electronically communicates with the printer. The printed information is then moved along the plurality of passages along with the dispensed product, ready to be sealed and delivered to a customer via the bagging unit 24 and retrieval bin 25.

The bagging unit 24 is positioned below the terminal passage 28, where it is positioned to receive and enclose products prior to releasing them into the retrieval bin 25. The bagging unit 24 accomplishes this via several components; it comprises a secondary door 241, a bag reserve 242, and a bag manipulating mechanism 244. The secondary door 241 both allows a purchased product to drop from the terminal passage 28 of the chutes into the bag, as well as opening the bag to receive said product. The bag reserve 242 is a chamber within the housing 1 that stores bags until needed, i.e. when a user makes a purchase. The bag manipulating mechanism 244 is a tool that is capable of moving individual bags from the bag reserve 242 to an area below the secondary door 241, where the bag is positioned to receive a purchased product.

Expanding upon the bagging unit 24, there is a first track 245 and a second track 246 upon which the bag manipulating mechanism 244. The bag manipulating mechanism 244 itself comprises a first pincer 247, a second pincer 248, and a telescoping body 249. The telescoping body 249 is slidably engaged with the first track 245 and the second track 246. This allows the bag manipulating mechanism 244 to move along a horizontal and vertical axis. This movement is critical as it enables the bag manipulating mechanism 244 to secure and move bags from the bag reserve 242 into position below the secondary door 241. More specifically, the a first end of the telescoping body 249 slides along said tracks, leaving an opposite end of the telescoping body 249 free to secure bags. The opposite end of the telescoping body 249 is where the first pincer 247 and the second pincer 248 are connected. The first pincer 247 and the second pincer 248 are thus capable of grasping a bag from the bag reserve 242, once properly positioned by moving the telescoping body 249 along the tracks.

The first track 245, which allows horizontal movement, is provided to allow the telescoping body 249 to move parallel to the bag reserve 242, as in the illustrated embodiment the bag reserve 242 comprises multiple rows oriented along a horizontal plane. The first track 245 allows the telescoping body 249 to move between rows of bags (e.g. moving to a full row after depleting another row), greatly increasing the storage capacity compared to an embodiment with only a single row of bags. The telescoping body 249 is capable of moving into or out of any given row of bags thanks to its telescoping nature; by having multiple sections which sleeve into one another, the telescoping body 249 can extend or retract along a horizontal axis. This allows the telescoping body 249 to extend into a row of bags, grasp the closest bag by clamping the first pincer 247 and the second pincer 248 about the bag, and retracting out of the row.

The second track 246 is oriented vertically, such that it is perpendicular to the first track 245. The second track 246 allows the bag manipulating mechanism 244 to move up and down along a vertical access; effectively, it can bring a grasped bag into position just below the secondary door 241. Once in position the secondary door 241 can be opened and the product drops into the bag, with the bag subsequently being sealed. To open up the bag, the secondary door 241 comprises a first door panel 261 and a second door panel 262 which open away from each other, commonly known as a French door design. The free end of each of these panels has a bag-opening hook 263 that opens the bag simultaneously as the door 215 panels open. This is a simple and effective manner of opening the bag in order to receive a purchased product from the terminal passage 28; however, this does not preclude the use of other components and methods for opening the bag via the bagging unit 24.

Similarly, different constructions can be used for the bag manipulating mechanism 244 itself. While the preferred embodiment utilizes a mechanical arm design, other choices are viable. Regardless of specific mechanisms used, they must be capable of moving the bags from a storage area (i.e. the bag reserve 242) into a position for receiving the purchased product (e.g. below the secondary door 241).

Additionally, it is preferable that the bag manipulating mechanism 244 is capable of sealing the bag after the product has been dropped into the bag through the secondary door 241. As with other aspects of the present invention, a myriad of possibilities exist for sealing the back. A few examples are provided; others still are possible and not ruled ineffective by their omission. One example of sealing the bags is applying pressure along a lip of the bag, i.e. zipper storage bags such as those produced by Ziploc. Another possibility is simply folding the bag via rotation of the bag manipulating mechanism 244, after which it is sealed shut by staples.

Once the bag has been sealed by the bag manipulating mechanism 244, it can be released into the retrieval bin 25. In the described embodiment, a bag is released by simply unclamping the first pincer 247 and second pincer 248, such that they no long clamp the bag and suspend it above the retrieval bin 25. The customer can then access their purchased product from the retrieval bin 25, after which point the purchasing and dispensing process can be repeated.

To better control the sales of the present invention (as may be desirable for certain products such as pharmaceuticals), in one embodiment of the present invention the terminal 11 comprises a wireless module 111, an identification module, an audio-visual module 113, and a processing module 114. These are supported by a power source 3 which is installed within the housing 1. These components allow for the present invention to employ a remote station, a "tender", to assist customers with making purchases and ensuring the unauthorized purchases are not made. This helps to prevent underage persons or those without prescriptions from purchasing restricted products. The tender is a person at a remote station who is able to monitor and assist with transactions of the vending machine by my means of the subcomponents of the terminal 11. The power source 3 is electrically connected to the wireless module 111, the identification module, the audio-visual module 113, and the processing module 114, providing the voltage necessary for their operation. The processing module 114 is provided to act as a hub, and is electronically connected to the wireless module 111, the identification module, and the audio-visual module 113. The wireless module 111 allows the tender to communicate with the terminal 11 from their remote station; the specific wireless standard can be any one which is considered optimal in terms of cost and effectiveness, e.g. a wireless network, a cellular network, or any other number of potential connection methods. The identification module verifies a customer's identity before dispensing restricted products, e.g. pharmaceuticals. The identification module ideally uses several methods to confirm an identity; one is a card reader 116, which requires a user enter an official identification for scanning and verification. Another is a fingerprint scanner 115, comparing the customer's fingerprints to records on file. Facial recognition software is also used, comparing input from the audio-visual system to stored data. By providing multiple layers of identity verification the present invention ensures that products are only sold to lawful customers. This helps to protect the vendor's owners from legal issues which might stem from selling restricted products to unapproved customers. The audio-visual module 113, via the processor module and wireless module 111, allows the tender to interact with a customer, the interaction being enabled by a camera 117, a microphone 118, and a speaker 119 of the audio-visual module 113. The camera 117 serves to help with customer identification, as it enables the tender to visually confirm the customer's identification, providing another layer of security. The microphone 118 and speaker 119 allow the tender to communicate with the customer. Thus, the tender can help walk a customer through the purchase process, make recommendations on which products are best suited for the individual customer, and in general address any questions or concerns the customer might have. The tender also helps first time customers create an account by providing personal information and data. The tender instructs a first time customer to place their finger in the fingerprint scanner 115, allowing a copy of the customer's fingerprints to be stored for future reference. The tender also instructs the first time customer to provide an identification card, which they customer will then be tied to, as well as stand still in order to allow the camera 117 to take a picture to link to the customer's account. The bud tender is able to lock the terminal 11 and prevent the new customer from placing an order if they fail to follow given instructions. The tender may also notify police if the customer engages in illegal actions.

Returning customers, i.e. those who have already created an account, simply verify their account by providing their identification card and fingerprint, as well as allowing for visual confirmation via the camera 117 and associated facial recognition software. Thus, a returning customer does not require the direct attention of a tender. After verifying their identity, the customer may choose to order products without assistance, e.g. "explore alone", or may ask for help or advice, e.g. "ask the experts". If a customer selects the latter option, a tender is linked to the customer, allowing the tender to assist with any issues the customer is having or simply provide recommendations on which available products would be best suited for the customer. To help make recommendations, the tender is provided with available customer purchase history, reviews, preferences of customer's friends, and general profile. This data helps the tender to make better recommendations that are tailored to the given customer. It is noted that the tender is only granted control to lock out a customer (provided the customer is not following proper procedures) or assist customers with decisions. A tender does not have the ability to change product pricing or to dispense products for free. To allow the tender to interface with the terminal 11 there a remote control program must be used; similarly, the software used for video conferencing, facial recognition, fingerprint scanning, and identification scanning is not limited to a specific software vendor.

The present invention also allows for customers to place preorders through an online site or mobile app, which can be communicated to a specific vending machine. A customer can then go to the vending machine and, after verifying their identification, confirm their order and retrieve their purchased product. Ideally, there are multiple terminal 11s provided, one explicitly for preorders, allowing a single vending machine to handle a larger number of customers compared to an embodiment with only a single terminal 11.

While a preferred embodiment has been described, several variations are possible without deviating from the scope of the present invention. Beyond potential variations which have been described, the present invention can operate primarily on mechanical aspects, or rely more heavily on electrical and electron components. For example, the various mechanisms described are often simple and effective nature, often being capable of actuation via hydraulics. At the same time, it is possible to provide electrically powered motors that operate components of the present invention, such as the switch 4, the doors 215, and the bag manipulating mechanism 244. Similarly, the control system and terminal 11 can be expanded upon to allow users to create a profile, which is wirelessly linked to an account, that can remember preferences or even receive and validate scripts from doctors. Effectively, the present invention can be set up as a standalone unit, or integrated into a healthcare network; both implementations will still adhere to the basic concept of the present invention, i.e. the relations and configurations of the housing 1, dispensing unit, bagging unit 24, retrieval bin 25, and their connecting passages.

Although the invention has been explained in relation to its preferred embodiment, it is to be understood that many other possible modifications and variations can be made without departing from the spirit and scope of the invention as hereinafter claimed.

What is claimed is:

1. A vending machine comprises:

a housing;

a dispensing system;

a controls system;

a terminal;

the dispensing system comprises a container unit, a printing unit, a bagging unit, a retrieval bin, a funnel, a primary passage, a detour passage, and a terminal passage;

the dispensing system being positioned within the housing;

the controls system being electrically connected between the terminal and the dispensing system, wherein the terminal activates the dispensing system through the controls system;

the funnel being positioned below the container unit;

the funnel being positioned atop the primary passage;

the funnel being connected to the bagging unit through the primary passage;

the funnel being connected to the printing unit through the detour passage;

the detour passage being forked from the primary passage, wherein the detour passage begins and ends at the primary passage;

a switch being connected within the primary passage adjacent to the detour passage, wherein the switch routes a dispensed product to a desired passage; and the bagging unit being connected to the retrieval bin through the terminal passage.

2. The vending machine as claimed in claim 1 comprises:

the terminal being adjacently connected into the housing; and the terminal being positioned external to the housing.

3. The vending machine as claimed in claim 1 comprises:

the bagging unit comprises a first door panel and a second door panel;

the first door panel and the second door panel each comprise a bag-opening hook;

the first door panel and the second door panel being positioned adjacent to the bagging unit; and the first door panel and the second door panel being interiorly and hingedly connected to the primary passage.

4. The vending machine as claimed in claim 1 comprises:

the container unit comprises a plurality of product-storing chutes;

each of the plurality of product-storing chutes comprises a loading end, a dispensing end, a retarding mechanism, and a door;

the loading end and the dispensing end being positioned opposite each other along the chamber;

the door being positioned at the dispensing end; and the retarding mechanism being positioned adjacent to the door.

5. The vending machine as claimed in claim 4 comprises:

each of the plurality of product-storing chutes further comprises an ejection mechanism; and the ejection mechanism being connected adjacent to the loading end, wherein the ejection mechanism pushes the dispensed product towards the dispensing end.

6. The vending machine as claimed in claim 1 comprises:

the bagging unit comprises a first door panel, a second door panel, a bag reserve, and a bag manipulating mechanism, wherein the bag manipulating mechanism selectively secures and seals dispensed bags;

the first door panel and the second door panel being positioned in the terminal passage between the container unit and the retrieval bin;

the bag reserve being positioned adjacent to the terminal passage; and the bag reserve opening into the terminal passage.

7. The vending machine as claimed in claim 6 comprises:

the bagging unit further comprises a first track and a second track;

the bag manipulating mechanism comprises a first pincer, a second pincer, and a telescoping body;

a first end of the telescoping body being slidably engaged with the first track and the second track;

the first pincer and the second pincer being rotatably connected to the telescoping body;

the first pincer and the second pincer being positioned at a second end of the telescoping body;

the first track and the second track being perpendicular to each other; and the first track and the second track intersecting each other.

8. The vending machine as claimed in claim 1 comprises:

the housing comprises a cover;

the removable cover being positioned adjacent to the container unit, wherein the container unit is accessible through the removable cover;

the container unit being positioned in a unit-receiving cavity of the housing; and the container unit being slidably engaged with the unit-receiving cavity, wherein the container unit can be removed from the unit-receiving cavity.

9. The vending machine as claimed in claim 1 comprises:

a power source;

the terminal comprises a wireless module, an identification module, an audio-visual module, and a processing module;

the power source being interiorly connected to the housing;

the power source being electrically connected to the wireless module, the identification module, the audio-visual module, and the processing module; and the processing module being electronically connected to the wireless module, the identification module, and the audio-visual module.

10. The vending machine as claimed in claim 9 comprises:

the identification module comprises a fingerprint scanner and a card reader; and the fingerprint scanner and the card reader each being externally mounted onto the housing.

11. The vending machine as claimed in claim 9 comprises:

the audio-visual module comprises a camera, a microphone, and a speaker; and the camera, the microphone, and the speaker each being externally mounted onto the housing.

12. A vending machine comprises:

a housing;

a dispensing system;

a controls system;

a terminal;

a power source;

the dispensing system comprises a container unit, a printing unit, a bagging unit, a retrieval bin, a funnel, a primary passage, a detour passage, and a terminal passage;

the terminal comprises a wireless module, an identification module, an audio-visual module, and a processing module;

the dispensing system being positioned within the housing;

the controls system being electrically connected between the terminal and the dispensing system, wherein the terminal activates the dispensing system through the controls system;

the funnel being positioned below the container unit;

the funnel being positioned atop the primary passage;

the funnel being connected to the bagging unit through the primary passage;

the funnel being connected to the printing unit through the detour passage;

the detour passage being forked from the primary passage, wherein the detour passage begins and ends at the primary passage;

a switch being connected within the primary passage adjacent to the detour passage, wherein the switch routes a dispensed product to a desired passage; and the bagging unit being connected to the retrieval bin through the terminal passage.

13. The vending machine as claimed in claim 12 comprises:

the terminal being adjacently connected into the housing; and the terminal being positioned external to the housing.

14. The vending machine as claimed in claim 12 comprises:

the bagging unit comprises a first door panel and a second door panel;

the first door panel and the second door panel each comprise a bag-opening hook;

the first door panel and the second door panel being positioned adjacent to the bagging unit; and the first door panel and the second door panel being interiorly and hingedly connected to the primary passage.

15. The vending machine as claimed in claim 12 comprises:

the container unit comprises a plurality of product-storing chutes;

each of the plurality of product-storing chutes comprises a loading end, a dispensing end, a retarding mechanism, and a door;

the loading end and the dispensing end being positioned opposite each other along the chamber;

the door being positioned at the dispensing end;

the retarding mechanism being positioned adjacent to the door;

each of the plurality of product-storing chutes further comprises an ejection mechanism; and the ejection mechanism being connected adjacent to the loading end, wherein the ejection mechanism pushes the dispensed product towards the dispensing end.

16. The vending machine as claimed in claim 12 comprises:

the bagging unit comprises a first door panel, a second door panel, a bag reserve, a bag manipulating mechanism, a first track, and a second track, wherein the bag manipulating mechanism selectively secures and seals dispensed bags;

the bag manipulating mechanism comprises a first pincer, a second pincer, and a telescoping body;

the secondary door being positioned in the terminal passage between the container unit and the retrieval bin;

the bag reserve being positioned adjacent to the terminal passage;

the bag reserve opening into the terminal passage;

a first end of the telescoping body being slidably engaged with the first track and the second track;

the first pincer and the second pincer being rotatably connected to the telescoping body;

the first pincer and the second pincer being positioned at a second end of the telescoping body;

the first track and the second track being perpendicular to each other; and the first track and the second track intersecting each other.

17. The vending machine as claimed in claim 12 comprises:

the housing comprises a cover;

the removable cover being positioned adjacent to the container unit, wherein the container unit is accessible through the removable cover;

the container unit being positioned in a unit-receiving cavity of the housing; and the container unit being slidably engaged with the unit-receiving cavity, wherein the container unit can be removed from the unit-receiving cavity.

18. The vending machine as claimed in claim 12 comprises:

the power source being interiorly connected to the housing;

the identification module comprises a fingerprint scanner and a card reader;

the audio-visual module comprises a camera, a microphone, and a speaker;

the power source being electrically connected to the wireless module, the identification module, the audio-visual module, and the processing module;

the processing module being electronically connected to the wireless module, the identification module, and the audio-visual module;

the fingerprint scanner and the card reader each being externally mounted onto the housing; and the camera, the microphone, and the speaker each being externally mounted onto the housing.

* * * * *